US005797728A

United States Patent [19]

Frith

[11] Patent Number: 5,797,728

[45] Date of Patent: Aug. 25, 1998

[54] DISK-SHAPED IMPELLER FOR MIXING FLUIDS

[76] Inventor: Donald E. Frith, 310 Poppinga Way, Santa Maria, Calif. 93455

[21] Appl. No.: 919,279

[22] Filed: Aug. 28, 1997

[51] Int. Cl.[6] ..... F04D 29/38

[52] U.S. Cl. ..... 416/231 A

[58] Field of Search ..... 416/231 A, 231 B, 416/231 R, 235

[56] References Cited

U.S. PATENT DOCUMENTS

| | | | |
|---|---|---|---|
| 3,044,559 | 7/1962 | Chajmik | 416/231 |
| 4,004,056 | 1/1977 | Carroll | 416/231 R |
| 5,224,821 | 7/1993 | Ozawa | 416/231 R |

FOREIGN PATENT DOCUMENTS

| | | | |
|---|---|---|---|
| 205680 | 1/1957 | Australia | 416/231 A |
| 568748 | 8/1977 | U.S.S.R. | 416/231 B |

*Primary Examiner*—John T. Kwon

*Attorney, Agent, or Firm*—Wall Marjama & Bilinski

[57] ABSTRACT

An impeller for mixing includes a disk having substantially identical top and bottom surfaces, opposed and spaced apart from each other and including a plurality of holes extending through the disk and arranged symmetrically around a circle having a smaller diameter than the disk. A first set of troughs, corresponding to a number of the plurality of holes, each trough having a portion having a width corresponding substantially to a width of the holes, is arranged on the top surface of the disk and each trough slopes downwardly from a periphery of the disk toward each of the holes, respectively. A second set of troughs, corresponding to a number of said plurality of holes, each trough having a portion having a width corresponding substantially to a width of the holes, is arranged on the bottom surface of the disk and each trough slopes upwardly from a periphery of the disk toward each of the holes, respectively.

18 Claims, 3 Drawing Sheets

DISK-SHAPED IMPELLER FOR MIXING FLUIDS

The present invention is directed generally to fluid mixing and agitating, and in particular to an impeller for fluid mixing and agitating.

BACKGROUND OF THE INVENTION

It is often desirable to mix suspended solid solutions before use. For example, in the production of ceramics, it is necessary to mix aqueous components with solid components to provide a homogeneous mixture, such as a slurry for slip casting. Additionally, when pigments are added to a base paint color it is necessary to completely and thoroughly combine the base and pigment so that a smooth and streakless color will result. Similarly, when a can of paint has not been used in some time, the various constituent parts of the paint tend to separate. It is therefore necessary to mix the paint prior to use.

For mixing and combining both liquid and dry materials, various types of mixing devices are known. In particular, an impeller, spinning at both high and low speeds, has been used for such purposes.

For example, it is customary to use a propeller-style mixing device as a drill attachment to mix paints, slurries and the like. U.S. Pat. No. 5,090,816 discloses a mixing device of this general type having a plurality of blades each having an elliptical flow-through hole formed therein to improve fluid flow. However, such a device can be dangerous to a person (e.g., a young child in a craft pottery studio) if removed from the mixed material before the blades stop spinning. Moreover, such a device tends to splash if dipped into liquid while spinning. Moreover still, the spinning blades can puncture a thin wall of a container (e.g., a plastic bucket) in which mixing usually takes place.

Other impellers include a shroud that connects together the distal ends of blades that extend from a central hub. For example, U.S. Pat. No. 167,774 discloses a churn having a plurality of spokes connected between a hub and a rim.

U.S. Pat. No. 390,367 discloses a propeller that includes blades that are attached to a hub at right angles to the hub and create, as the blades fan out, substantially circular openings D between the hub and a periphery. The openings project diagonally through the wheel in a double curve or S-shaped line.

U.S. Pat. No. 506,572 discloses a propeller having blades that extend from a hub and are connected by a peripheral rim.

U.S. Pat. No. 1,072,189 discloses a one-piece rotary fan in which all of the blades are contained within the planes of opposite sides of a rim to thereby protect the blades from contacting adjacent objects.

Finally, U.S. Pat. No. 3,826,591 discloses a shrouded propeller wherein the shroud tapers from a smaller opening to a larger opening to produce an axial flow of fluid with minimal turbulence.

Each of the foregoing devices, however, still includes relatively sharp blades that can be very dangerous when spinning outside of the intended fluid to be mixed.

Other types of impellers have also been known. For instance, U.S. Pat. No. 1,655,447 discloses a paint mixer having a disk-shaped body with radial slots bordered by upwardly turned vanes.

U.S. Pat. No. 2,984,462 discloses a mixing device comprising a disk having a plurality of holes. Some of the holes are not fully punched and are left with scoops that project downward. Various ridges, projecting downwardly and upwardly, are arranged to increase the turbulence created by the spinning disk.

Both of these last two devices however, while having an overall disk shape, also have sharp projections extending away from the plane of the surface of the disk. Those sharp projections pose a personal injury threat when the disk is spinning even at low speeds.

SUMMARY OF THE INVENTION

It is therefore an object of the present invention to provide an efficient impeller for mixing liquids, fluids or the like while substantially reducing the risk of bodily injury caused by sharp projections.

It is a further object of the present invention to provide an impeller that is simple to manufacture and therefore inexpensive.

It is further still an object of the present invention to provide an impeller that can be used in containers having thin metal or plastic walls without the risk of puncturing the side of the container.

To achieve these and other objects, the present invention comprises a disk having spaced apart and substantially planar top and bottom surfaces perpendicular to the axis of rotation of the impeller and a continuous circumferential surface connecting the top and bottom surfaces. A plurality of holes extend through the disk. Each hole is provided with a trough on either side of the disk, the trough extending from the periphery of each hole to the outer periphery of the disk.

The disk of the present invention also includes a circumferential edge extending continuously around a periphery of the disk.

In a preferred embodiment, the impeller has four holes that are 90 degrees offset from each other. Also, the troughs associated with adjacent holes are perpendicular to one another and troughs associated with holes opposite to one another are parallel to each other.

The impeller can be made from one of ceramic, plastic, and metal and is preferably a unitary, monolithic body with a center hole for attachment to, for example, a shaft of an electric drill.

Each trough has a substantially arcuate cross section and the angle with respect to the top and bottom surfaces of each of the troughs increases as each of the troughs approaches its associated hole.

Preferably, the width of all of the troughs is substantially identical. Further, the width of at least one of the troughs can taper from its associated hole to the periphery of the disk, e.g., a truncated cone. Particularly, the width of at least one of the troughs can taper inwardly from its associated hole to the periphery of the disk. Moreover, the width of at least one of the troughs can taper outwardly from its associated hole to the periphery of the disk.

For added safety, the impeller's circumferential edge is rounded.

The holes of the impeller, in one embodiment, are substantially circular and have a constant diameter.

Finally, the top and bottom surfaces are substantially planar between the troughs.

BRIEF DESCRIPTION OF THE DRAWINGS

These and other objects will become more apparent and better understood from the detailed description of the present invention considered in conjunction with the accompanying drawings in which.

DETAILED DESCRIPTION OF THE INVENTION

Figure 1:
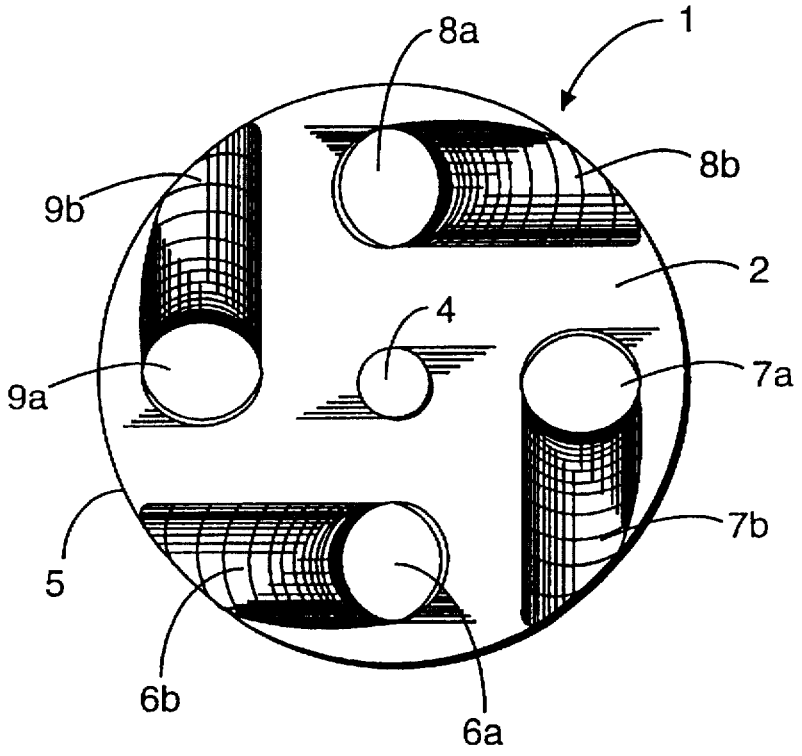
FIG. 1 is a perspective view of the impeller according to the present invention.
Figure 3:
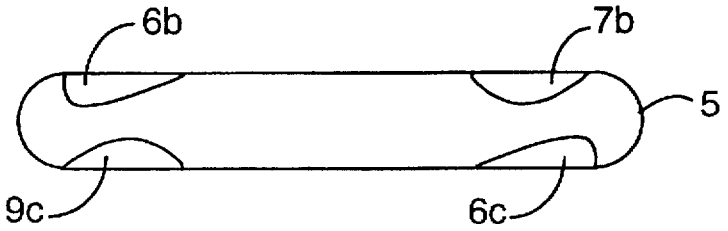
FIG. 3 is a side view of the impeller of FIG. 1.

Referring to FIG. 1, an impeller according to the present invention is shown in perspective view. The impeller substantially resembles a disk 1 and includes a top surface 2 and a bottom surface 3 substantially parallel to and spaced from each other. A center hole 4, the use of which is explained later herein, is provided along a diameter of the disk 1. An edge 5 connects the top and bottom surfaces 2, 3 and runs continuously around the circumference of the disk 1. Edge 5 is preferably rounded as is seen, for example, in FIG. 3 to enhance the safety features of the present invention.

In a preferred embodiment, four holes 6*a*, 7*a*, 8*a*, 9*a* extend through disk 1 and are spaced equidistant and equiangular from each other and the center hole 4. In the case where four holes are provided, as shown, each hole is spaced 90 degrees from its next adjacent hole.

Figure 2A:
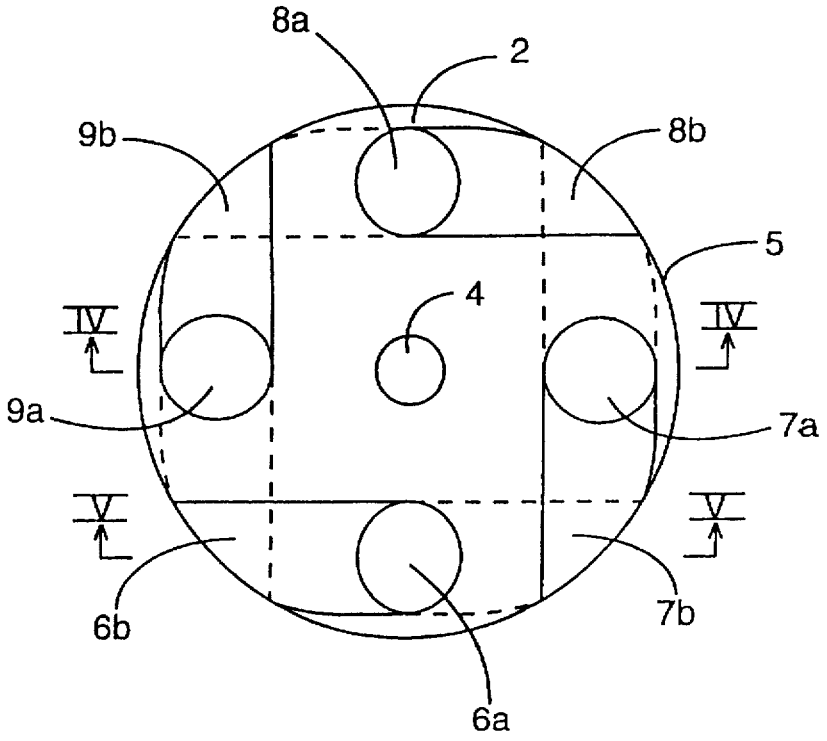
FIGS. 2A and 2B are, respectively, top and bottom plan views of the impeller of FIG. 1.
Figure 2B:
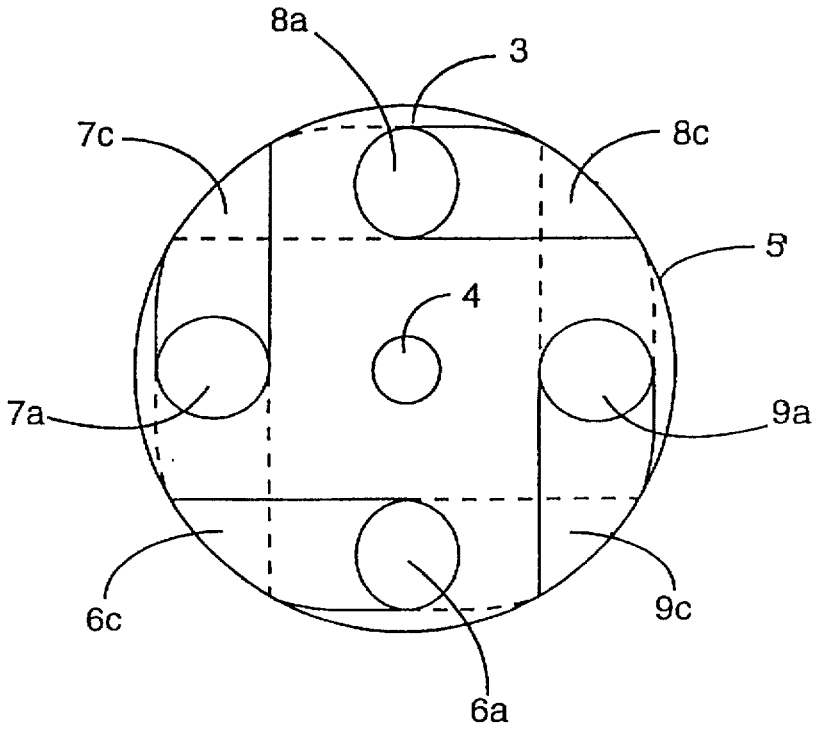

Referring now to FIGS. 2A and 2B, each hole has two associated troughs, one on each side of the disk. In particular, using hole 6*a*, for example, a trough 6*b* (FIG. 2A) extends from the periphery of hole 6*a* to edge 5 parallel to a chord of the disk. Now referring to FIG. 2B, a trough 6*c* extends along the same chord as trough 6*b*, and extends in the opposite direction toward edge 5. The troughs 6*c*–9*c* formed in the bottom surface 3 of the disk 1 are shown as dotted lines in FIG. 2A. Likewise, troughs 6*b*–9*b* formed in the top surface 2 of the disk 1 are shown as dotted lines in FIG. 2B.

Thus, as shown in the figures, the troughs are arranged such that they cross underneath each other. For example, trough 6*c* crosses underneath trough 7*b* at a substantially perpendicular angle. Also, when there are an even number of holes (four not necessarily being a lower or higher limit for the number of holes) opposite pairs of troughs are substantially parallel to each other. Troughs 7*b* and 9*b* illustrate one example of such an arrangement.

Figure 4:
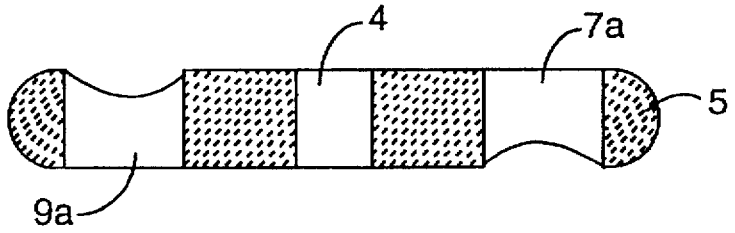
FIG. 4 is a cross sectional view taken along line IV—IV of FIG. 3A.

FIG. 4 shows a cross sectional view taken through a diameter of the disk 1 through holes 7*a* and 9*a* and shows that holes 7*a* and 9*a* pass entirely through the disk 1.

Figure 5:
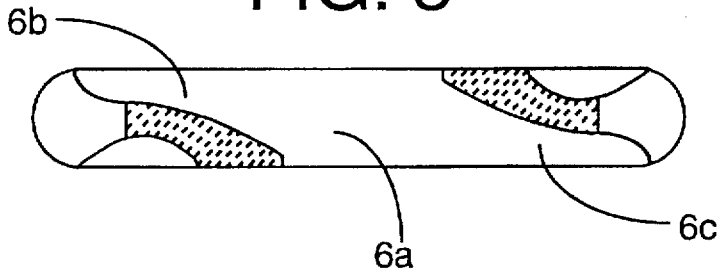
FIG. 5 is a cross sectional view taken along line V—V of FIG. 3A.

Next, as is best understood form FIG. 5 and FIG. 1, the troughs 6*b*, 7*b*, 8*b*, 9*b* that are provided in the top surface 2 of the disk 1, all slope downwardly from the periphery of the disk toward each hole. On the bottom surface 3, on the other hand, the troughs 6*c*, 7*c*, 8*c*, 9*c* slope upwardly from the periphery of the disk 1 toward each of the holes.

Preferably, the slope angle of each trough increases as it approaches its associated hole. However, this feature is not essential.

As is now apparent from the above description of the impeller of the present invention, the top and bottom surfaces 2, 3 of the disk are substantially identical. That is, the disk 1 does not really have a top and bottom per se since the disk 1 can be used with either the top surface 2 or bottom surface 3 oriented upwards. In view of the substantially identical nature of the top and bottom surfaces, the impeller of the present invention could be manufactured in two sections (both being substantially identical) and then joined together at an appropriate offset angle.

Troughs 6*b*–*c*, 7*b*–*c*, 8*b*–*c*, 9*b*–*c*, are preferably substantially arcuate in cross section. However, the troughs may also have rectangular cross sections or any cross sectional shape that will permit proper functioning of the impeller, as will be explained later herein.

Preferably, the disk 1 is made from ceramic or plastic material (e.g., thermosetting resin) which provides both low weight and high durability. Of course, any other material, even metal, could be used to manufacture the impeller according to the present invention. The impellers can be cast, injection molded, machined, and the like, although injection molding would likely be most efficient.

Also, while the widths of the troughs are shown as matching the diameter of the holes, the troughs can have either smaller or larger widths compared to the diameter of the holes. The troughs may also have tapered shapes.

In a preferred embodiment, the disk 1 is approximately three inches wide and a half inch thick. The center hole 4 is about ⅜ inch wide and each hole 6*a*, 7*a*, 8*a*, 9*a* is approximately ⅝ inch wide. The troughs extending from each hole are preferably about one inch long. The above dimensions are particularly well suited for mixing solutions contained in standard size paint cans and smaller containers used in, for example, a ceramic art studio.

To use the impeller of the present invention, one end of a driving shaft (not shown) is attached to the center hole 4 by any know means including screwing, press fitting, bolting or the like, and the other end of the driving shaft is attached to a manual or automatic turning apparatus, such as an electric motor or drill (also not shown). The disk 1 is submerged in a mixture to be mixed and the driving shaft is caused to turn thereby spinning the disk 1. As the disk 1 spins in a clockwise direction, when the top surface 2 of the disk is directed upwards, the mixture fills the troughs 6*b*, 7*b*, 8*b*, 9*b*, passes through holes 6*a*, 7*a*, 8*a*, 9*a* and is forced downward and away from the disk 1 by the troughs 6*c*, 7*c*, 8*c*, 9*c*, respectively, thereby producing a jet-like discharge of the mixture and causing in a confined region strong mixing currents. Of course, the same effect occurs when the bottom surface 3 is directed upwards and the top surface 2 is directed downwards. Thus, both axial and circumferential force imparted to the fluid in a container thereby causing currents of fluid and providing the desired mixing or agitating action. The circumferential force imparted to the fluid, however, is such that circumferential splattering of liquid when the impeller is removed from the liquid while still spinning is reduced. This is an added advantage of the present invention not shared by traditional propeller-type mixing devices.

Significantly, since the top and bottom surfaces 2, 3 of the disk 1 contain no sharp protruding edges and the edge 5 of the disk 1 is rounded, even if the disk 1 contacts a side wall of a container while spinning, that wall will likely not be punctured due to the smooth nature and unitary construction of the impeller.

Furthermore, if the impeller is removed from the fluid that is being mixed before the impeller stops spinning, the chance of bodily injury is also reduced due to the smooth and rounded construction of the impeller.

While a particular structure and use of the impeller according to the present invention have been described in certain detail, it will be understood by those skilled in the art that various modifications and embodiments of the present invention may be used without departing from the present invention which is defined by the following claims.

What is claimed is:

1. An impeller for mixing, comprising:

a disk having top and bottom surfaces, opposed and spaced apart from each other and including a plurality of holes extending from said top surface to said bottom surface and arranged symmetrically around a circle having a smaller diameter than said disk;

a first set of troughs, corresponding to a number of said plurality of holes, each trough having a portion having a width corresponding substantially to a width of said holes, being arranged on said top surface of said disk and sloping downwardly from a periphery of said disk toward each of said holes, respectively; and a second set of troughs, corresponding to a number of said plurality of holes, each trough having a portion having a width corresponding substantially to a width of said holes, being arranged on said bottom surface of said disk and sloping upwardly from a periphery of said disk toward each of said holes, respectively.

2. The impeller of claim 1, further comprising a circumferential edge extending continuously around a periphery of said disk.

3. The impeller of claim 2, wherein said circumferential edge is rounded.

4. The impeller of claim 1, wherein four holes are provided in said disk 90 degrees offset from each other.

5. The impeller of claim 4, wherein the troughs associated with adjacent holes are perpendicular to one another and troughs associated with holes opposite to one another are parallel to each other.

6. The impeller of claim 1, wherein the disk comprises one of ceramic, plastic, and metal.

7. The impeller of claim 1, wherein the disk is a unitary, monolithic body.

8. The impeller of claim 1, further comprising a center hole for attachment to a shaft of a drill assembly.

9. The impeller of claim 1, wherein a cross section of each of said troughs is substantially arcuate.

10. The impeller of claim 1, wherein the angle with respect to the top and bottom surfaces of each of said troughs increases as each of said troughs approaches its associated hole.

11. The impeller of claim 1, wherein the width of all of said troughs is substantially identical.

12. The impeller of claim 1, wherein the width of at least one of said troughs tapers from its associated hole to the periphery of said disk.

13. The impeller of claim 12, wherein the width of at least one of said troughs tapers inwardly from its associated hole to the periphery of said disk.

14. The impeller of claim 12, wherein the width of at least one of said troughs tapers outwardly from its associated hole to the periphery of said disk.

15. The impeller of claim 1, wherein at least one of said plurality of holes is substantially circular.

16. The impeller of claim 15, wherein said at least one hole has a constant diameter.

17. The impeller of claim 1, wherein said top and bottom surfaces are substantially planar.

18. The impeller of claim 1, wherein said top and bottom surfaces are substantially identical.

* * * * *